US009333779B2

(12) United States Patent
Komiya

(10) Patent No.: US 9,333,779 B2
(45) Date of Patent: May 10, 2016

(54) PRINTER

(71) Applicant: BROTHER KOGYO KABUSHIKI KAISHA, Nagoya-shi, Aichi (JP)

(72) Inventor: Hidekazu Komiya, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/728,252

(22) Filed: Jun. 2, 2015

(65) Prior Publication Data

US 2015/0343813 A1 Dec. 3, 2015

(30) Foreign Application Priority Data

Jun. 3, 2014 (JP) ..... 2014-115034

(51) Int. Cl.
*B41J 25/304* (2006.01)

(52) U.S. Cl.
CPC ..... *B41J 25/304* (2013.01)

(58) Field of Classification Search
CPC ..... B41J 11/20; B41J 11/02; B41J 25/308; B41J 25/304; B41J 12/06
USPC ..... 347/20
See application file for complete search history.

(56) References Cited

U.S. PATENT DOCUMENTS 3,669,393 A * 6/1972 Paine ..... F16M 13/02 248/188.4
5,855,463 A * 1/1999 Newby ..... F16B 39/18 411/244
6,669,422 B1 * 12/2003 Sterle ..... F16B 5/0233 411/178
2004/0057809 A1 * 3/2004 Nakagami ..... F16B 39/24 411/368
2008/0056809 A1 * 3/2008 Kielczewski et al. ..... 403/118

FOREIGN PATENT DOCUMENTS

JP 2006-240107 A 9/2006

OTHER PUBLICATIONS

Superior Washer & Gasket Corp., http://www.superiorwasher.com/blog/utilize-friction-resist-washer-materials-best (Aug. 21, 2015).*

* cited by examiner

*Primary Examiner* — Alessandro Amari
*Assistant Examiner* — Michael Konczal
(74) *Attorney, Agent, or Firm* — Fox Rothschild LLP

(57) ABSTRACT

A printer includes a discharge portion, a platen, a support portion, a female screw, an adjusting member, an engaging member, and a spring. The discharge portion discharges a liquid. The platen has a platen hole, is disposed to face the discharge portion, and supports a printing medium. The support portion is disposed on the opposite side of the platen from the discharge portion and faces the platen. The adjusting member is rotatably attached to the platen by being inserted into the platen hole, and screws into the female screw provided on the support portion. The engaging member is disposed between the platen and the female screw, and engages with the adjusting member. The spring is disposed around the circumference of the adjusting member, between the engaging member and the female screw. The spring generates a restoring force when the spring compressed between the engaging member and the female screw.

9 Claims, 9 Drawing Sheets

PRINTER

CROSS-REFERENCE TO RELATED APPLICATION

This application claims priority to Japanese Patent Application No. 2014-115034 filed Jun. 3, 2014, the content of which is hereby incorporated herein by reference.

BACKGROUND

The present disclosure relates to a printer that has a platen that supports a printing medium.

A printer is known that has a platen that supports a printing medium. For example, the printer may be an inkjet recording device that is provided with a platen, a platen mounting plate, support members, screws, and nuts. Through-holes are formed in each of the platen and the platen mounting plate. When the platen is superposed on the platen mounting plate, the positions of the through-holes are aligned. The support members are disposed between the platen and the platen mounting plate. The support members are cylinders that are formed from an elastic rubber. The screws are inserted through the support members and the through-holes in the platen and the platen mounting plate and are tightened with the nuts. The thicknesses of the elastic support members are varied by adjusting the degree to which the screws and nuts are tightened. Varying the thicknesses of the elastic support members varies the distance between the platen and the platen mounting plate. The levelness of the platen is adjusted by varying the distance between the platen and the platen mounting plate.

SUMMARY

However, in the known inkjet recording device that is described above, the levelness of the platen can be adjusted only within the range within which the thicknesses of the elastic support members can be varied. Therefore, the range within which the levelness of the platen can be adjusted is small, so it is possible that the leveling of the platen will be inadequate. The possibility also exists that backlash will occur when the levelness of platen is adjusted. If the leveling of the platen is inadequate or backlash of the platen occurs, there is a possibility that the printing quality will be affected, such as by shifts in the positions where ink droplets that are discharged from a head land on the printing medium.

Embodiments of the broad principles derived herein provide a printer that ensures the printing quality by performing the leveling of the platen adequately and decreasing the backlash of the platen.

A printer according to the present disclosure includes a discharge portion, a platen, a support portion, a female screw, an adjusting member, an engaging member, and a spring. The discharge portion is configured to discharge a liquid. The platen is disposed to face the discharge portion and is configured to support a printing medium. A platen hole is formed in the platen. The support portion is disposed on the opposite side of the platen from the discharge portion, and is configured to face the platen. The female screw is provided on the support portion and includes a threaded hole. The adjusting member is provided with a male screw that screws into the female screw. The adjusting member is configured to be rotatably attached to the platen by being inserted into the platen hole. The engaging member is disposed between the platen and the female screw. The engaging member engages with the male screw of the adjusting member. The spring is disposed around the circumference of the adjusting member, between the engaging member and the female screw. The spring generates a restoring force when the spring compressed between the engaging member and the female screw.

BRIEF DESCRIPTION OF THE DRAWINGS

Embodiments will be described below in detail with reference to the accompanying drawings in which.

DETAILED DESCRIPTION

Hereinafter, an embodiment of the present disclosure will be explained with reference to the drawings. The drawings are used for explaining technological features that the present disclosure can utilize, and they do not serve to restrict the content of the present disclosure. First, a configuration of a printer 1 will be explained with reference to FIGS. 1 to 6. The top side, the bottom side, the lower left side, the upper right side, the lower right side, and the upper left side in FIG. 1 respectively correspond to the top side, the bottom side, the front side, the rear side, the right side, and the left side of the printer 1.

Figure 1:
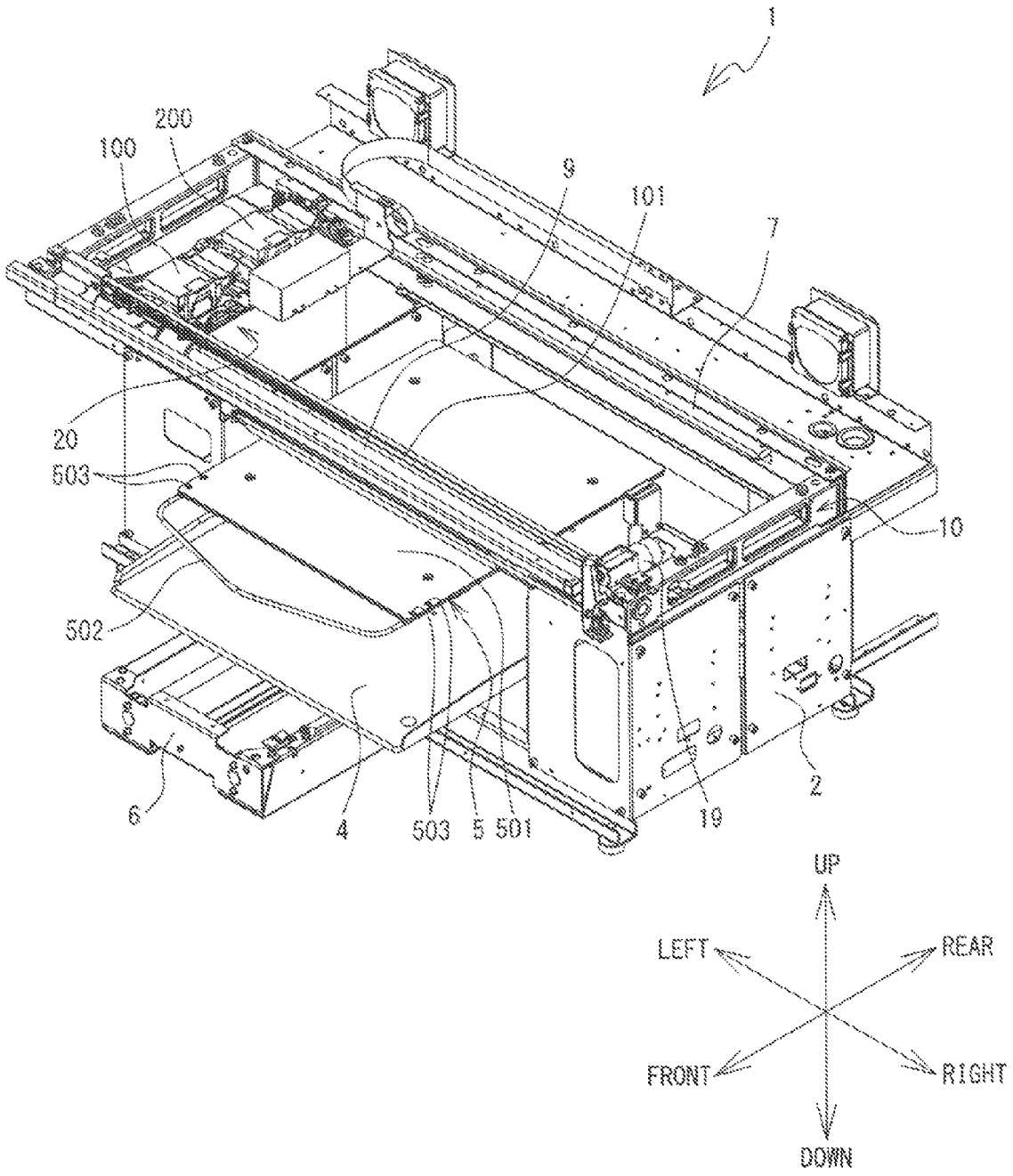
FIG. 1 is an oblique view of a printer 1.

As shown in FIG. 1, the printer 1 is an inkjet printer that, by discharging a liquid ink, performs printing on a cloth (not shown in the drawings), such as a T-shirt or the like, that is a printing medium. The printing medium may also be a paper or the like. In the present embodiment, the printer 1 is able to print a color image on the printing medium by discharging five different types of the ink downward. The five types of the ink are white (W), black (K), yellow (Y), cyan (C), and magenta (M). In the explanation that follows, of the five types of the ink, the four colored inks, black, cyan, yellow, and magenta, will be collectively called the color inks, and the white ink will be called the white ink. The front-rear direction of the printer 1 is a secondary scanning direction in which the printer 1 conveys the printing medium, and the left-right direction of the printer 1 is a main scanning direction.

The printer 1 is provided with a housing 2, a platen drive mechanism 6, a pair of guide rails 3, 3 (refer to FIG. 2), a platen 5, a tray 4, a frame body 10, a guide shaft 9, a rail 7, a carriage 20, support portions 21L, 21R (refer to FIG. 2), head units 100, 200, a drive belt 101, and a drive motor 19.

The housing 2 is substantially a three-dimensional rectangle whose long axis extends from left to right. An operation portion (not shown in the drawings) that performs operations of the printer 1 is provided on the front side of the right portion of the housing 2. The operation portion is provided with a display and operation buttons. The display displays various types of information. An operator operates the operation buttons when inputting commands that are related various types of operations of the printer 1.

The frame body 10 has a frame shape that is substantially rectangular in a plan view, and it is installed in the top portion of the housing 2. The front side of the frame body 10 supports the guide shaft 9, and the rear side of the frame body 10 supports the rail 7. The guide shaft 9 is a shaft member that is provided with a shaft portion that extends from left to right on the inner side of the frame body 10. The rail 7 is a rod-shaped member that is disposed opposite the guide shaft 9 and extends from left to right.

Figure 2:
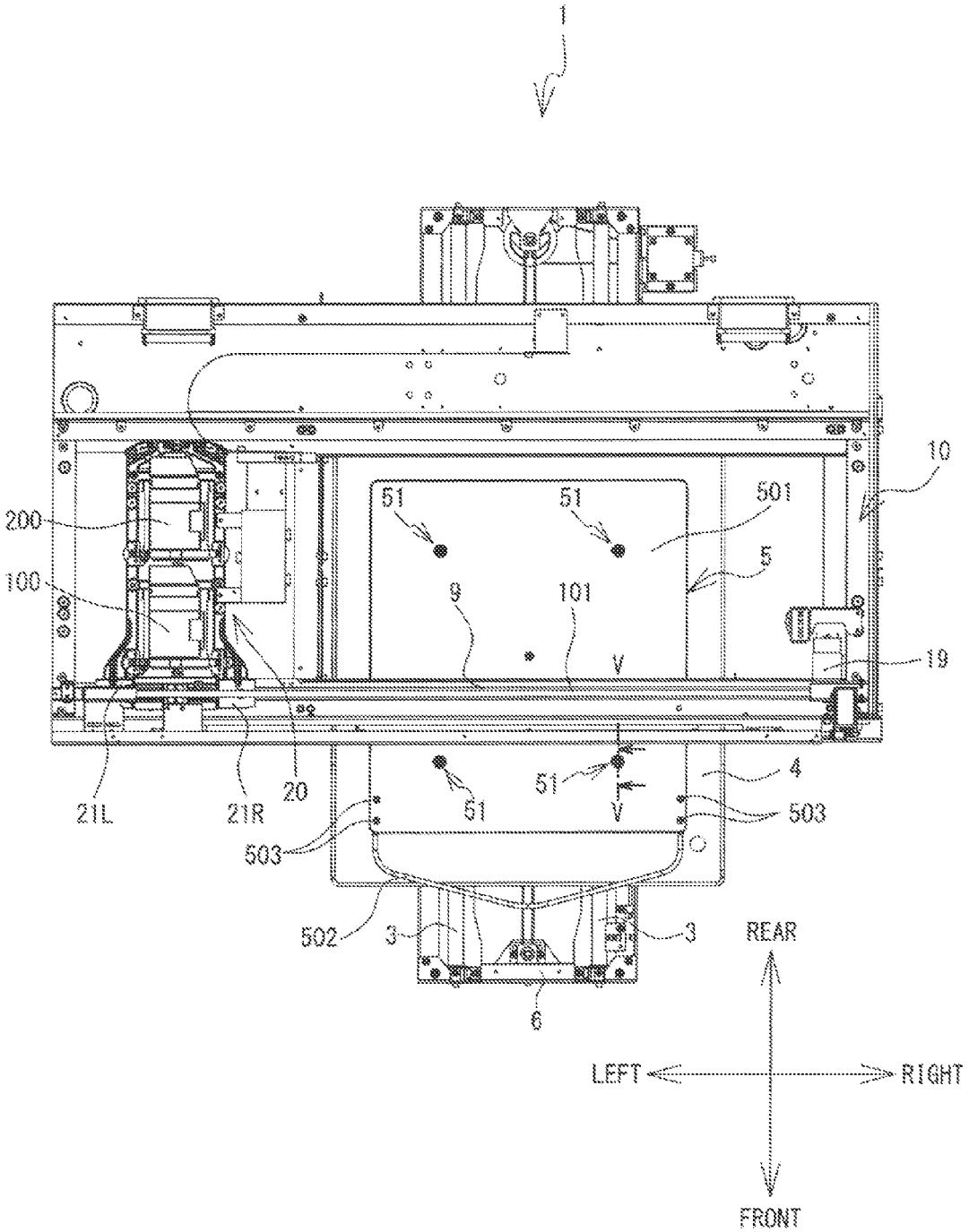
FIG. 2 is a plan view of the printer 1.

The carriage 20 is supported such that it can be conveyed to the left and the right along the guide shaft 9. As shown in FIG. 2, the support portions 21L, 21R are provided on the front end of the carriage 20. The support portions 21L, 21R are inserted through the guide shaft 9 and support the carriage 20 such that it can slide along the guide shaft 9. The head units 100, 200 are carried on the carriage 20 and are arrayed in the front-rear direction. The head unit 100 is disposed in front of the head unit 200. A head portion that is not shown in the drawings is provided on the bottom face of each of the head units 100, 200. A flat discharge face that is parallel to the horizontal plane is formed on the bottom face of the head portion. A plurality of tiny discharge openings are provided in the discharge face. Each of the discharge openings is able to discharge one of the white ink and the color inks downward.

The drive belt 101 has a belt shape that spans the inner side of the frame body 10 in the left-right direction. The drive belt 101 is made of rubber. The drive motor 19 is provided in the front right portion of the inner side of the frame body 10. The drive motor 19 is capable of rotating forward and in reverse, and it is coupled to the carriage 20 through the drive belt 101. When the drive motor 19 drives the drive belt 101, the carriage 20 moves reciprocally to the left and the right along the guide shaft 9. The head units 100, 200 are moved reciprocally to the left and the right by the reciprocal movement of the carriage 20. On the bottom sides of the head units 100, 200, the inks are discharged toward the platen 5, which is disposed such that it faces the head units 100, 200. The discharging of the inks from the head portions of the head units 100, 200 causes the printing to be performed on the printing medium that is supported by the platen 5. When the printing is performed, the platen 5 is conveyed toward the front and the rear by the platen drive mechanism 6.

Figure 3:
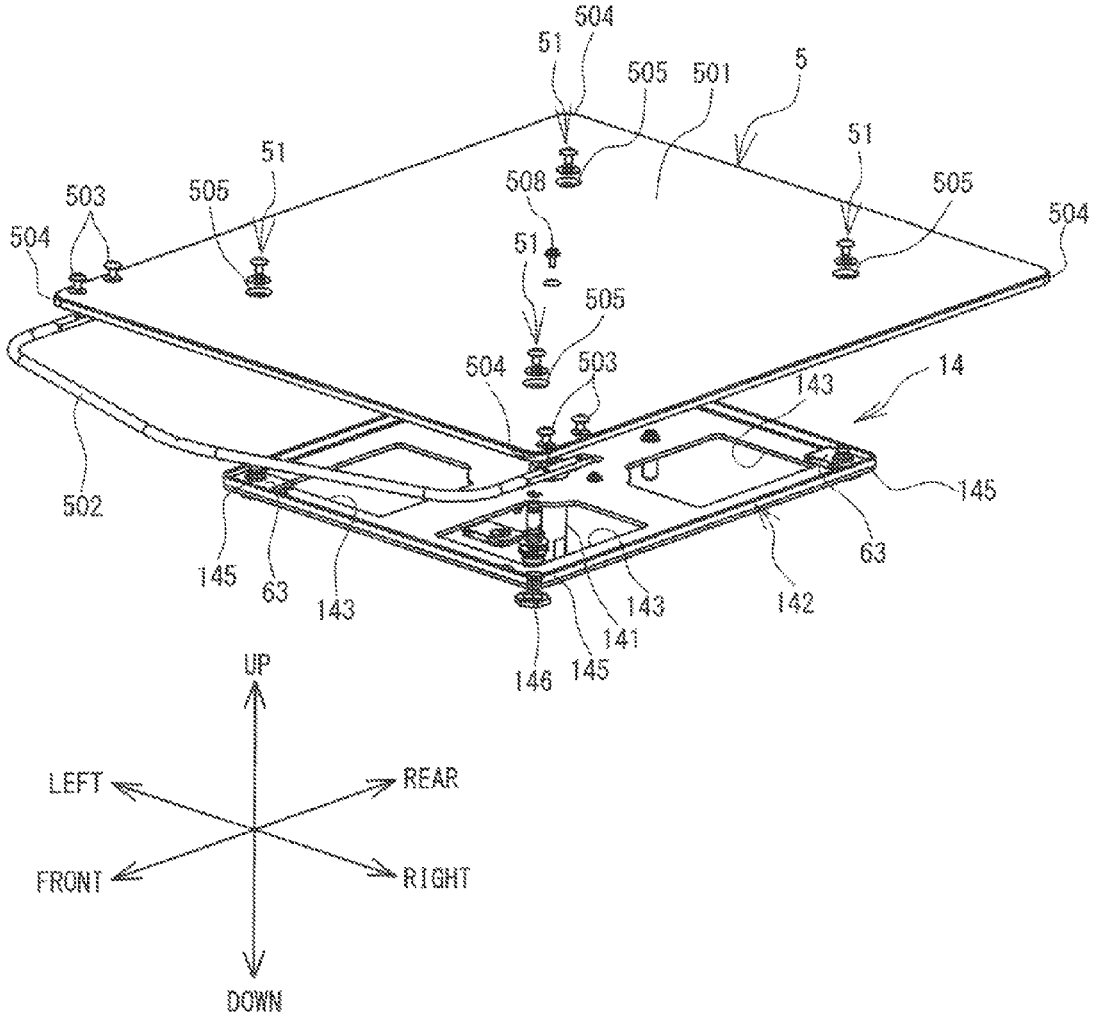
FIG. 3 is an exploded oblique view of a platen 5, a platen support base 14, and a leveling mechanism 51.

The platen drive mechanism 6 is provided with the pair of the guide rails 3, 3 (refer to FIG. 2) and a platen support base 14 (refer to FIG. 3). Using a motor (not shown in the drawings) that is provided on its rear end, the platen drive mechanism 6 moves the platen support base 14 toward the front and the rear of the housing 2 along the pair of the guide rails 3, 3. The pair of the guide rails 3, 3 support the platen support base 14 such that it can be conveyed toward the front and the rear. As shown in FIG. 3, the platen support base 14 is a member that supports the platen 5. The platen support base 14 is provided underneath the platen 5, on the opposite side of the platen 5 from the head units 100, 200, and it faces the platen 5 (refer to FIGS. 3 and 5).

The platen support base 14 is provided with a support column 141 and a plate portion 142. The support column 141 is a circular cylinder that extends vertically. The tray 4 is rectangular in a plan view and is provided below the platen 5. By receiving the sleeves and the like of the T-shirt that the operator has placed on the platen 5, the tray 4 protects the sleeves and the like such that they do not come into contact with other parts in the interior of the housing 2.

Figure 4:
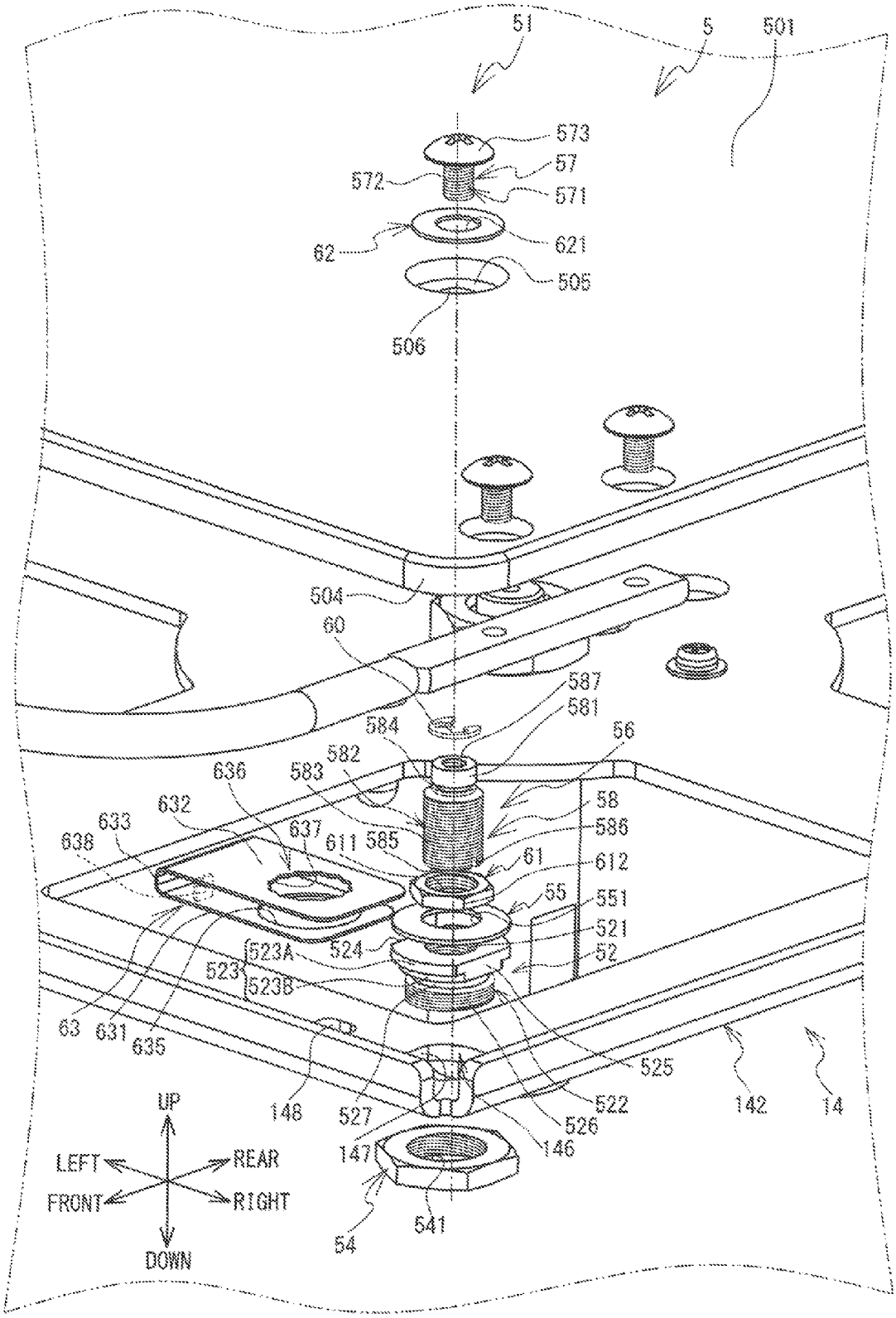
FIG. 4 is an enlarged view of the central portion of FIG. 3.

The central portion of the plate portion 142 is affixed to the upper end of the support column 141. As shown in FIG. 3, the plate portion 142 is made of metal and has a plate shape that is rectangular in a plan view. Substantially rectangular openings 143 that extend vertically through the plate portion 142 are provided between the center and each of four corners 145 of the plate portion 142. A plate hole 146 that is a circular hole in a plan view is provided close to each of the four corners 145. Note that the plate hole 146 that is provided in the right front corner 145 is shown in FIGS. 3 and 4. Note also that the corner 145 and the opening 143 on the left rear side of the platen support base 14 are obscured by the platen 5, so they are not shown in the drawings. A pair of flat portions 147 are provided opposite one another inside each of the plate holes 146. Only the flat portion 147 that is formed on the left side of the plate hole 146 and that extends in the front-rear direction is shown in FIG. 4, but the other flat portion 147, which also extends in the front-rear direction, is formed on right side of the plate hole 146.

A leveling mechanism 51 is disposed in each of the four plate holes 146. The platen 5 is attached to the upper ends of the leveling mechanisms 51. For example, cases occur in which the top face of the platen 5 is inclined in relation to the horizontal plane, due to warping or the like in the platen 5, but the operator can use the leveling mechanisms 51 to adjust the levelness of the platen 5, such that the top face of the platen 5 becomes parallel to the horizontal plane. The leveling mechanisms 51 will be described in detail later.

As shown in FIGS. 2 and 3, the platen 5 is provided with a plate portion 501 and a cloth support portion 502. The plate portion 501 is substantially rectangular in a plan view, with its long axis extending in the front-rear direction of the housing 2. The size of the plate portion 501 in a plan view is larger than that of the plate portion 142 of the platen support base 14. The cloth support portion 502 is formed by a rod member that is bent, and it extends between the left front portion and the right front portion of the plate portion 501 such that it is bowed outward toward the front from the plate portion 501. The cloth support portion 502 is affixed to the plate portion 501 by a plurality of screws 503. In a case where the printing medium is a T-shirt, for example, when setting the T-shirt such that it covers the platen 5, the operator disposes the neck and shoulder portions of the T-shirt along the cloth support portion 502.

Figure 5:
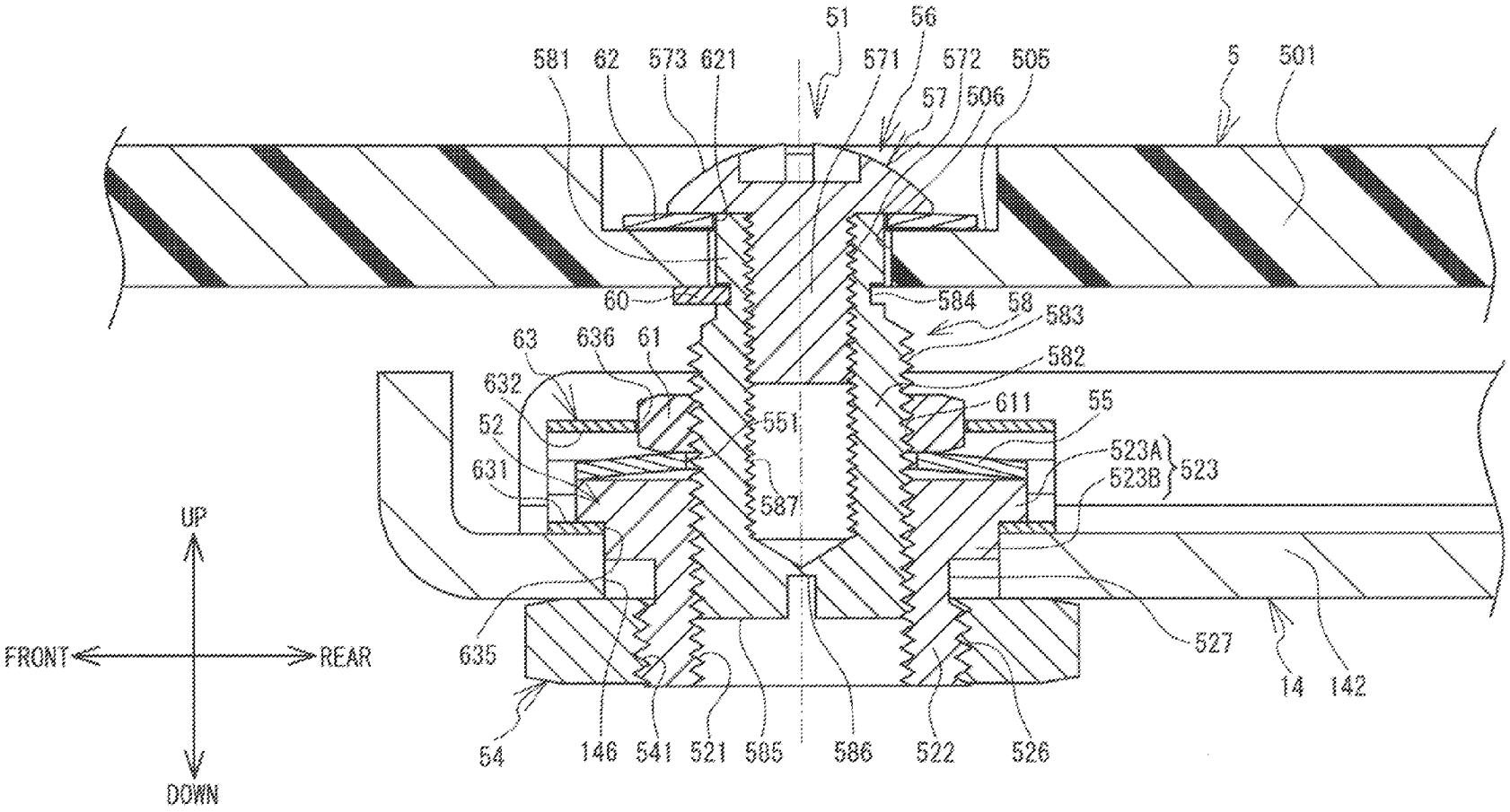
FIG. 5 is a section view from the direction of arrows on a line V-V in FIG. 2.

As shown in FIG. 3, the central portion of the plate portion 501 is joined to the upper end of the support column 141 of the platen support base 14 by a male screw 508. Platen recessed portions 505 are provided between the center and each of four corners 504 of the plate portion 501. The four platen recessed portions 505 are circular in a plan view and are recessed downward from the top face of the plate portion 501. As shown in FIGS. 4 and 5, a platen hole 506 that is a hole that extends vertically through the plate portion 501 is provided in the center of the each of the four platen recessed portions 505 in a plan view. The leveling mechanisms 51 are inserted into the platen holes 506.

As shown in FIG. 3, the platen 5 is provided with the four leveling mechanisms 51. The four leveling mechanisms 51 correspond to the four platen recessed portions 505 and the four platen holes 506. By separately adjusting the vertical positioning of the platen 5, the four leveling mechanisms 51 adjust the top face of the platen 5 such that it is level. As shown in FIGS. 4 and 5, the leveling mechanism 51 is provided with a threaded member 52, a nut 54, a first disk spring 55, a nut 61, an adjusting screw 56, a retaining ring 60, a second disk spring 62, and a rotation locking member 63.

The threaded member 52 is a female threaded member that includes a threaded hole 521 that extends vertically through the threaded member 52. The threaded member 52 is provided with a cylindrical portion 522 and a flange portion 523. The cylindrical portion 522 is a circular cylinder that extends vertically. The flange portion 523 is connected to the upper end of the cylindrical portion 522 and extends radially outward. The flange portion 523 is provided with a first component 523A, a second component 523B, and side faces 524, 525. The first component 523A forms the upper end of the flange portion 523. The second component 523B is a component that is formed below the first component 523A, and as shown in FIG. 5, it extends radially outward a shorter distance than does the first component 523A. That is, the diameter of the second component 523B is smaller than the diameter of the first component 523A. Therefore, a step shape is formed by the first component 523A and the second component 523B. The side faces 524, 525 are vertically parallel flat faces that are provided on opposite sides of the threaded hole 521, and they extend vertically over both the first component 523A and the second component 523B.

A slot 527 that is recessed radially inward is formed at the upper end of the cylindrical portion 522. A male thread 526 is formed around the circumference of the cylindrical portion 522 in the area below the slot 527. The nut 54 is a hexagonal nut that has a threaded hole 541 that engages with the male thread 526.

The first disk spring 55 is circular in a plan view, and it has a hole 551 in its center. The diameter of hole 551 is greater than the diameter of a shaft 582 of a second screw 58 that are described below. The first disk spring 55 is sloped such that it is higher toward the inside in the radial direction and lower toward the outside. The first disk spring 55 is compressed when pressure bears on it from above and below, and when it is compressed, it generates a restoring force.

The adjusting screw 56 is configured from a first screw 57 and the second screw 58 (refer to FIG. 5). The first screw 57 is a male screw that includes a shaft 571, around the circumference of which a male thread 572 is formed, and a head 573. The second screw 58 has a substantially cylindrical shape that extends vertically. The second screw 58 is provided with a tip 581, the shaft 582, a slot 584, a bottom face 585, and a threaded hole 587. The tip 581 forms the upper end portion of the second screw 58. The shaft 582 is provided below the tip 581. A male thread 583 is formed around the circumference of the shaft 582. The male thread 583 engages with the threaded hole 521 of the threaded member 52. The slot 584 is provided between the tip 581 and the shaft 582 and is recessed radially inward. The bottom face 585 is a face on the lower end of the shaft 582. A notch 586 that is notched upward is provided in the bottom face 585 and forms a straight line in a bottom view. The threaded hole 587 extends downward from the upper end of the tip 581. In FIG. 5, the bottom end of the second screw 58 is closed off by the bottom face 585, but the threaded hole 587 of the second screw 58 may also extend through to the bottom of the second screw 58.

The retaining ring 60 is a known E-shaped retaining ring and is disposed around the circumference of the slot 584. The nut 61 includes a threaded hole 611 that engages with the male thread 583 of the second screw 58. The nut 61 is a hexagonal nut that has six vertices 612 around its circumference (refer to FIG. 4). The second disk spring 62 is circular in a plan view and has a hole 621 in its center. The diameter of the hole 621 is greater than the diameter of the shaft 571 of the first screw 57. The second disk spring 62 is sloped such that it is higher toward the inside in the radial direction and lower toward the outside. The second disk spring 62 is compressed when pressure bears on it from above and below, and when it is compressed, it generates a restoring force.

The rotation locking member 63 is formed by the bending of a single metal plate. The rotation locking member 63 is provided with a pair of wall portions 631, 632 that face one another in the up-down direction, and with a connecting portion 633 that connects the left ends of the pair of the wall portions 631, 632. Within the pair of the wall portions 631, 632, a hole 635 that is circular in a plan view is provided in the wall portion 631 on the lower side. A hole 636 is provided in the wall portion 632 on the upper side. The hole 636 has a circular shape and in a plan view is provided around its circumference with projections and recesses that engage with the nut 61. Projections 637 that project inward are provided on the inner circumferential face of the hole 636. A total of twelve of the projections 637 are provided at 30-degree intervals around the inner circumferential face of the hole 636 in a plan view. A plate-shaped projecting portion 638 that projects downward is provided on the left edge of the wall portion 631, approximately midway between the front and rear edges.

An example of a method for attaching the leveling mechanisms 51 will be explained. Note that the leveling mechanisms 51 are attached in four locations, but the attaching method is the same in each case, so the method for attaching the leveling mechanism 51 in one location will be explained below.

As shown in FIG. 4, in a state in which the second screw 58 is not engaged with the first screw 57, the nut 61 is engaged with the male thread 583 of the second screw 58. The first disk spring 55 is disposed on the top side of the threaded member 52, which is the side that faces the platen 5. The male thread 583 of the second screw 58 is engaged with the threaded hole 521 of the threaded member 52 through the hole 551 in the first disk spring 55. The first disk spring 55 is therefore disposed around the circumference of the shaft 582 of the second screw 58. When the various components are thus arranged, the nut 61 is positioned on the top side of the first disk spring 55, which is the side that faces the platen 5. The nut 61 is turned and moves downward. The nut 61 presses the first disk spring 55 against the threaded member 52, compressing the first disk spring 55.

In a state in which the restoring force of the metal plate that forms the rotation locking member 63 energizes the wall portions 631, 632 of the rotation locking member 63 in directions that move them away from each other, the cylindrical portion 522 of the threaded member 52 is inserted into the hole 635. The second screw 58 and the nut 61 are inserted into the hole 636. The cylindrical portion 522 of the threaded member 52 is also inserted into the plate hole 146 from above the plate portion 142. The nut 54 is engaged with the cylindrical portion 522 from below the plate portion 142. As shown in FIG. 5, the wall portion 631 of the rotation locking member 63 is positioned around the circumference of the second component 523B of the flange portion 523. Furthermore, the rotation locking member 63 and the plate portion 142 are held between the top face of the nut 54 and the bottom face of the first component 523A of the flange portion 523. The projecting portion 638 is inserted into a hole 148. The hole 148 restricts the rotational movement of the projecting portion 638 such that the rotation of the rotation locking member 63 is prevented. The disposing of the side faces 524, 525 such that they are in contact with the pair of the flat portions 147 of the plate hole 146 from the left and right side, respectively, prevents the threaded member 52 from rotating. The configuration described above causes the threaded member 52 and the rotation locking member 63 to be affixed to the platen support base 14. Furthermore, the hole 636 in the rotation locking member 63 is disposed around the circumference of the nut 61. In a state in which the rotation locking member 63 is supported by the platen support base 14, the rotation locking member 63 locks the rotation of the nut 61.

Note that the projections 637 that are formed in the hole 636 of the rotation locking member 63 (refer to FIG. 4) are provided at 30-degree intervals along the inner circumferential face of the hole 636. When the operator presses the wall portion 632 downward, the projections 637 are disposed between the first disk spring 55 and the outer circumferential portion of the nut 61. In this state, when the nut 61 is turned, the vertices 612 do not come into contact with the projections 637. This configuration allows the nut 61 to be turned in increments of 30 degrees and to be held in those positions. In other words, the operator is able to set the amount of tightening of the nut 61 as desired by turning the nut 61 in 30-degree increments.

As shown in FIGS. 4 and 5, the retaining ring 60 is disposed in the slot 584 of the second screw 58. The tip 581 of the second screw 58 is inserted into the platen hole 506. In a state in which the second disk spring 62 is disposed around the circumference of the shaft 571, the male thread 572 of the first screw 57 is engaged with the threaded hole 587 of the second screw 58. In this state, the operator puts a Phillips screwdriver into the head 573 of the first screw 57, puts a flat-blade screwdriver into the notch 586 of the second screw 58, and tightens the first screw 57 and the second screw 58 against one another. The tightening causes the first screw 57 and the second screw 58 to engage firmly with one another to form the adjusting screw 56 as a single unit. In a case where the first screw 57 and the second screw 58 have been tightened against one another, the second disk spring 62 is compressed between the head 573 and the platen recessed portion 505. The second disk spring 62 and the platen 5 are also held between the bottom face of the head 573 and the top face of the retaining ring 60, creating a state in which the adjusting screw 56 is attached such that it can be rotated in relation to the platen 5.

The procedure that is described above puts the leveling mechanism 51 into a state in which it is attached to the printer 1. Note that, as shown in FIG. 5, the bottom face 585, which is the end of the adjusting screw 56 that faces downward from the platen 5 toward the platen support base 14, is positioned higher, that is, closer to the platen 5, than is the downward-facing end of the threaded member 52. In other words, the bottom end of the adjusting screw 56 does not project farther downward than the bottom end of the threaded member 52. The order in which the individual parts of the leveling mechanism 51 are assembled is not limited to the example that is described above, and the parts may also be assembled in a different order from that described above.

Figure 6:
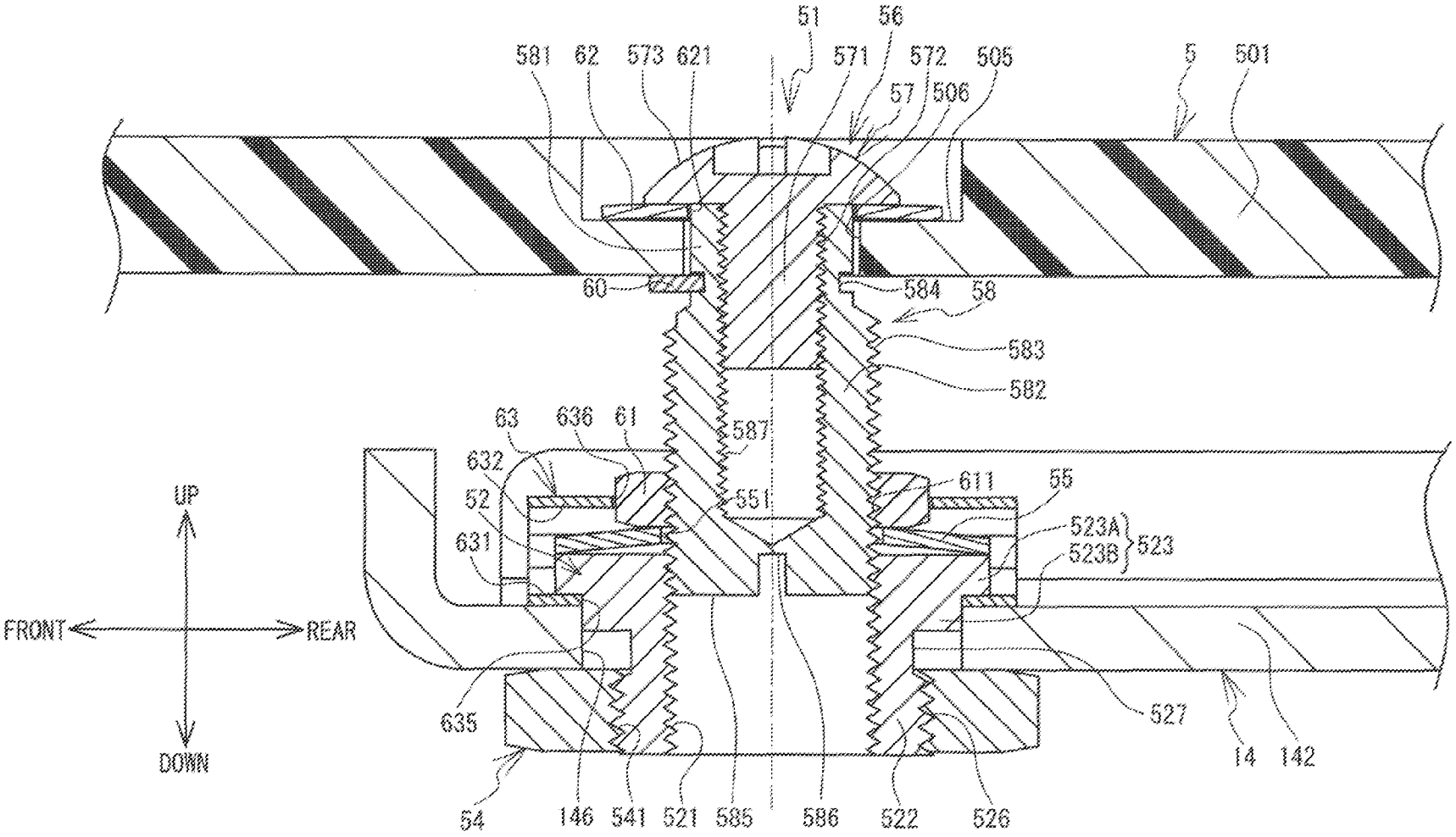
FIG. 6 is a section view of a state in which an adjustment screw 56 that is shown in FIG. 5 has been turned and the platen 5 has moved upward.

A method for leveling the platen 5 will be explained. The operator can adjust the levelness of the platen 5 by adjusting the leveling mechanisms 51 in the four locations to move the vertical position of the platen 5 up and down. FIG. 6 shows a state in which the platen 5 has been moved upward from the position of the platen 5 that is shown in FIG. 5.

When the operator puts a Phillips screwdriver into the head 573 and turns the adjusting screw 56, the adjusting screw 56 moves up and down in relation to the threaded member 52, as shown in FIGS. 5 and 6. The platen 5 moves up and down in conjunction with the movement of the adjusting screw 56. The distance between the platen 5 and the platen support base 14 therefore changes. Accordingly, by turning the adjusting screws 56 of the leveling mechanisms 51 in the four locations, the operator is able to adjust the levelness of the platen 5 by moving the position of the platen 5 up and down. Note that because the notch 586 is provided on the bottom end of the adjusting screw 56, the platen 5 may also be leveled by putting a flat-blade screwdriver into the notch 586 from below and turning the adjusting screw 56.

The levelness adjustment of the platen 5 is performed as described above. As shown in FIG. 5, in the present embodiment, the first disk spring 55 is disposed in a state in which it is compressed between the nut 61 and the threaded member 52. This arrangement creates a state in which the nut 61 and the threaded member 52 are pushed away from one another (that is, upward and downward, respectively) around the circumference of the adjusting screw 56, such that they are pressed against the male thread 583 of the adjusting screw 56. Accordingly, the possibility that the adjusting screw 56 will wobble in relation to the nut 61 and the threaded member 52 can be reduced from what it would be if the first disk spring 55 were not provided. Therefore, the possibility that backlash will occur in the platen 5 that is attached to the adjusting screw 56 can also be reduced, and the printing quality can be ensured. Furthermore, the levelness of the platen 5 can be adjusted within the vertical range in which the male thread 583 of adjusting screw 56 engages with the threaded hole 521 of the threaded member 52. Therefore, the range in which the levelness can be adjusted is greater than in a case where the levelness of the platen can be adjusted only within the range in which the thicknesses of elastic support members can be varied, as in the known printer. Accordingly, the levelness of the platen 5 can be adequately adjusted, and the printing quality can be ensured.

The adjusting screw 56 and the nut 61 may also wobble in a case where the first disk spring 55 is not provided, for example. If the nut 54 that is disposed below the threaded member 52 is tightened in order to inhibit backlash, the height of the platen 5 is shifted by the amount of looseness in the nut 54. Therefore, when the levelness adjustment of the platen 5 is performed, additional effort will be required for the levelness adjustment in the form of loosening the nut 54, readjusting the height of the platen 5, and the like. In the present embodiment, because the first disk spring 55 is provided, the adjusting screw 56 and the nut 61 are resistant to wobbling. Therefore, the height of the platen 5 is resistant to shifting. Moreover, in a case where the levelness of the platen 5 is adjusted by turning the adjusting screw 56, there is no need to tighten the nut 54 in order to inhibit backlash. Accordingly, the operator can adjust the levelness of the platen 5 more easily than would be the case if the first disk spring 55 were not provided in the leveling mechanism 51.

The rotation locking member 63, which locks the rotation of the nut 61, is also provided. The nut 61 is therefore more resistant to turning than would be the case if the rotation locking member 63 were not provided in the leveling mechanism 51, and the nut 61 resists turning in conjunction with the turning of the adjusting screw 56. Accordingly, the distance between the nut 61 and the threaded member 52 tends not to change, and the restoring force of the first disk spring 55 is maintained. The possibility that backlash will occur in the platen 5 that is attached to the adjusting screw 56 can be reduced accordingly.

Furthermore, the bottom end of the adjusting screw 56 does not project farther downward than the bottom end of the threaded member 52. Therefore, in a case where the printing medium is disposed on the platen 5, the printing medium is less likely to get caught on the adjusting screw 56 than would be the case if the adjusting screw 56 were to project farther downward than the threaded member 52. It is therefore easy to arrange the printing medium on the platen 5. The external appearance of the leveling mechanism 51 is also better than would be the case if the adjusting screw 56 projected farther downward than the threaded member 52.

Furthermore, the projections 637 that are formed in the hole 636 of the rotation locking member 63 (refer to FIG. 4) are provided at 30-degree intervals. The operator is therefore able to set amount of tightening of the nut 61 as desired by turning the nut 61 in 30-degree increments. Changing the amount of tightening changes the amount of compression of the first disk spring 55, which in turn changes the restoring force. Changing the restoring force of the first disk spring 55 changes the force with which the first disk spring 55 inhibits backlash. Changing the restoring force of the first disk spring 55 also changes the frictional force between the adjusting screw 56 and the nut 61 and changes the frictional force between the adjusting screw 56 and the threaded member 52. The force that is required in order to turn the adjusting screw 56 therefore changes. Therefore, by setting the amount of tightening as desired in 30-degree increments, the operator is easily able to vary the force with which the first disk spring 55 inhibits backlash. The force that is required in order to turn the adjusting screw 56 to adjust the levelness of the platen 5 can also be changed easily.

Note that the present disclosure is not limited to the embodiment that is described above, and various types of modifications can be made. For example, the liquid that is discharged in the printer 1 is not limited to an ink, and various other types of liquids may be used, such as a discharge printing agent or the like that removes a color with which a cloth has been dyed. A spring washer that generates a restoring force when it is compressed may also be used instead of the first disk spring 55. The threaded member 52 is provided with the male thread 526 around the circumference of the cylindrical portion 522 and is attached to the plate portion 142 by the engaging of the nut 54 with the male thread 526. However, the threaded member 52 may also be attached to the plate portion 142 by being pressed into the plate portion 142.

The bottom end of the adjusting screw 56 may also project farther downward than the bottom end of the threaded member 52. The twelve projections 637 in the rotation locking member 63 are provided at 30-degree intervals around the inner circumferential face of the hole 636, the number of the projections 637 is not limited. For example, if twenty-four of the projections 637 are provided at 15-degree intervals around the inner circumferential face of the hole 636, the turning of the nut 61 can be set in 15-degree increments. The rotation locking member 63 may also lock the nut 61 such that the nut 61 does not rotate at all. The shape of the rotation locking member 63 is also not limited, as long as the rotation locking member 63 locks the rotation of the nut 61. It is also acceptable for the rotation locking member 63 not to be provided.

Figure 7:
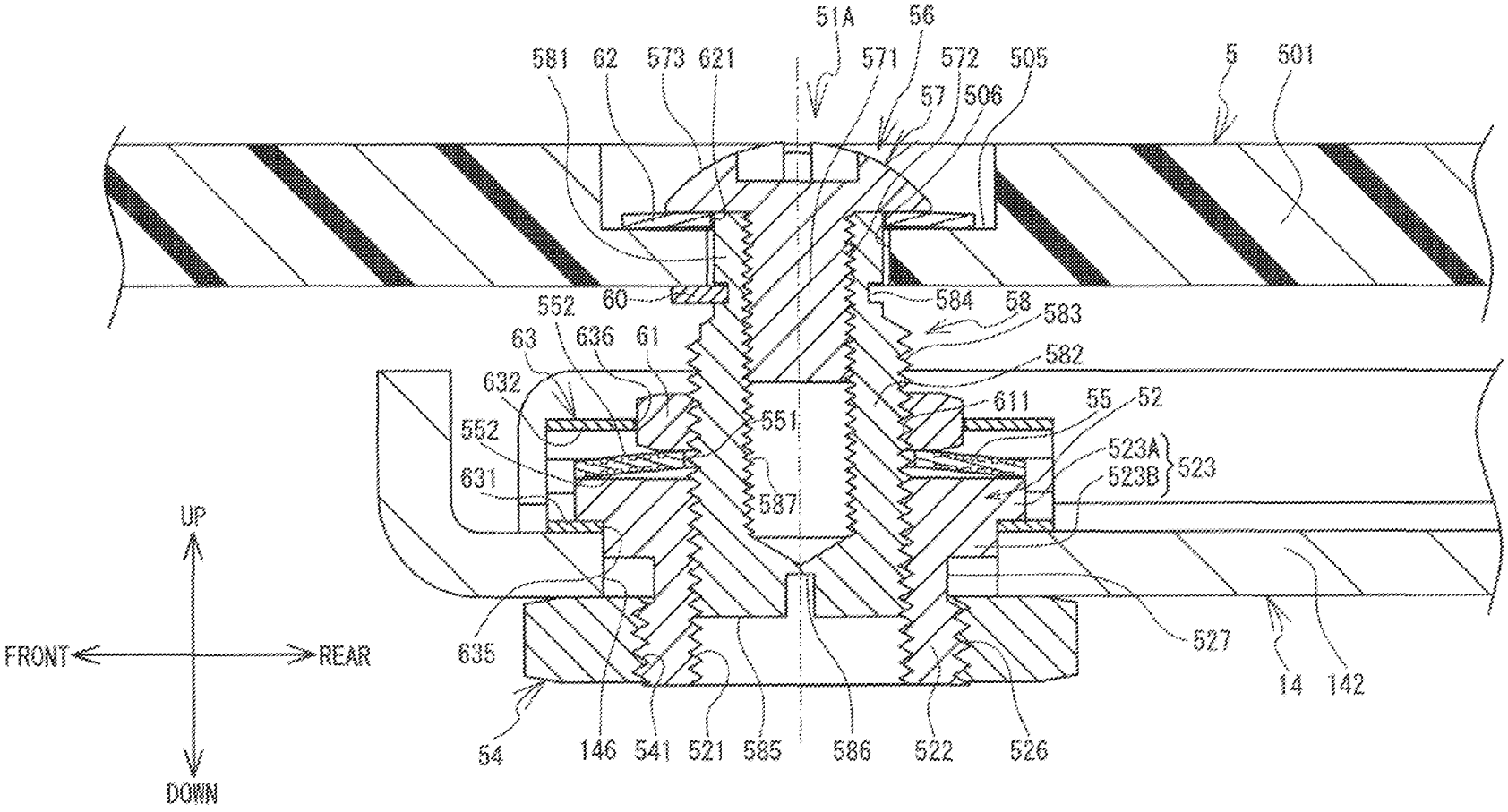
FIG. 7 is a section view of a leveling mechanism 51A according to a modified example.

Raised and recessed portions 552 may also be formed in the surfaces of the first disk spring 55, as in a leveling mechanism 51A according to a modified example that is shown in FIG. 7. In a case where the raised and recessed portions 552 are formed in the surfaces of the first disk spring 55, the frictional force between the nut 61 and the first disk spring 55 and the frictional force between the threaded member 52 and the first disk spring 55 are greater than they are in a case where the raised and recessed portions 552 are not formed in the surfaces of the first disk spring 55. Because the frictional forces on the first disk spring 55 become greater, the nut 61 and the threaded member 52 become more resistant to turning when the operator turns the adjusting screw 56. The distance between the nut 61 and the threaded member 52 therefore becomes less likely to change, and the restoring force of the first disk spring 55 is maintained. The possibility that backlash will occur in the platen 5 that is attached to the adjusting screw 56 can be reduced accordingly. Note also that, of the two surfaces of the first disk spring 55, the raised and recessed portions 552 may be provided in only one of the upper surface and the lower surface.

Figure 8:
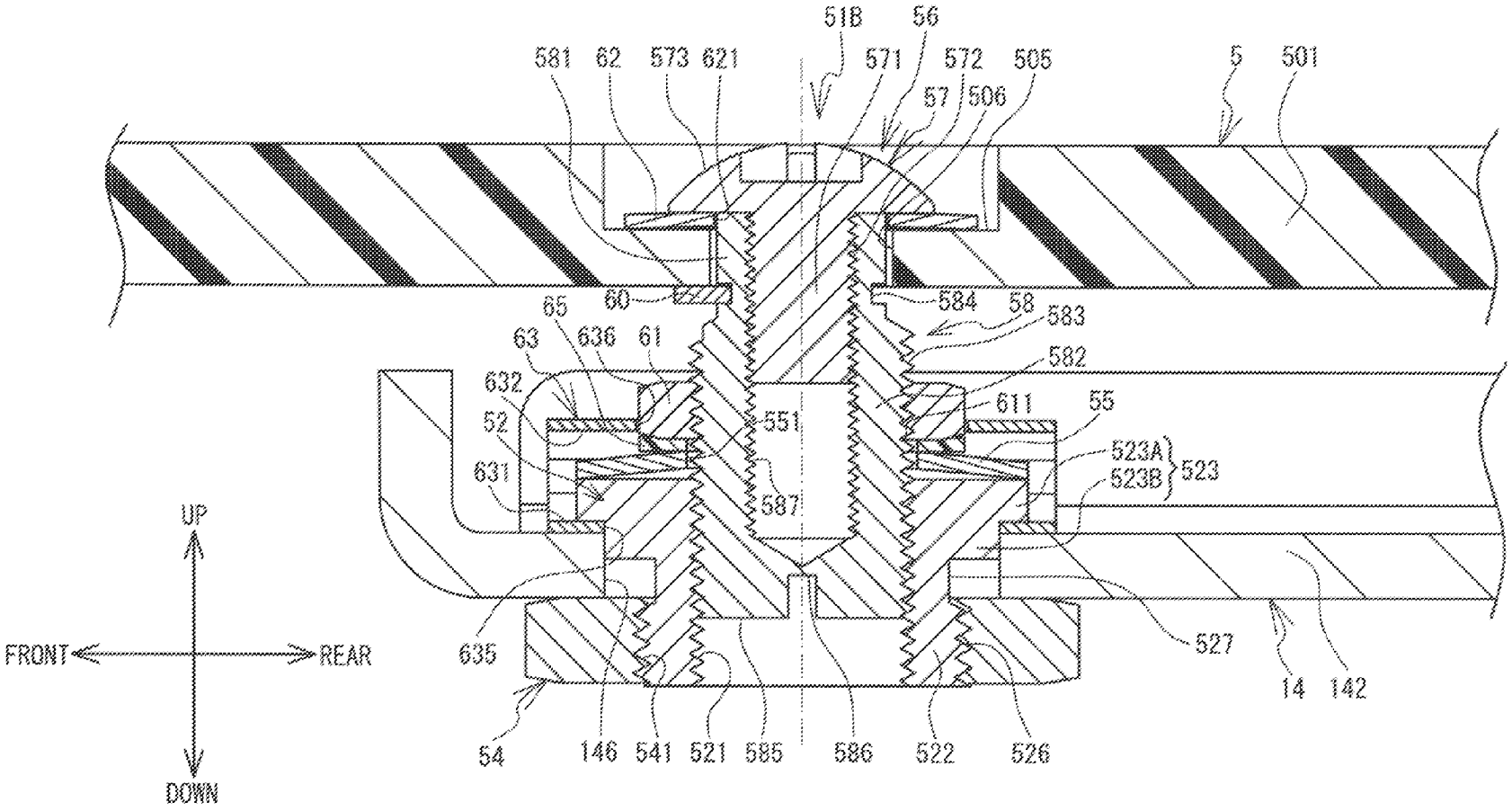
FIG. 8 is a section view of a leveling mechanism 51B according to a modified example.

A sheet 65 may also be disposed between the nut 61 and the first disk spring 55, as in a leveling mechanism 51B according to a modified example that is shown in FIG. 8. The sheet 65 is circular in a plan view, with a hole in the its center, and it is disposed around the circumference of the shaft 582 of the adjusting screw 56. The sheet 65 may be made of a synthetic resin, for example. A frictional force that is generated between the sheet 65 and the first disk spring 55 and a frictional force that is generated between the sheet 65 and the nut 61 are greater than the frictional force that is generated between the first disk spring 55 and the nut 61 that are shown in FIG. 6. In this case, because the frictional forces are greater, the nut 61 becomes more resistant to turning when the adjusting screw 56 is turned than it is in a case where the sheet 65 is not provided. The distance between the nut 61 and the threaded member 52 is therefore less likely to change, and the restoring force of the first disk spring 55 is maintained. The possibility that backlash will occur in the platen 5 that is attached to the adjusting screw 56 can therefore be reduced.

Figure 9:
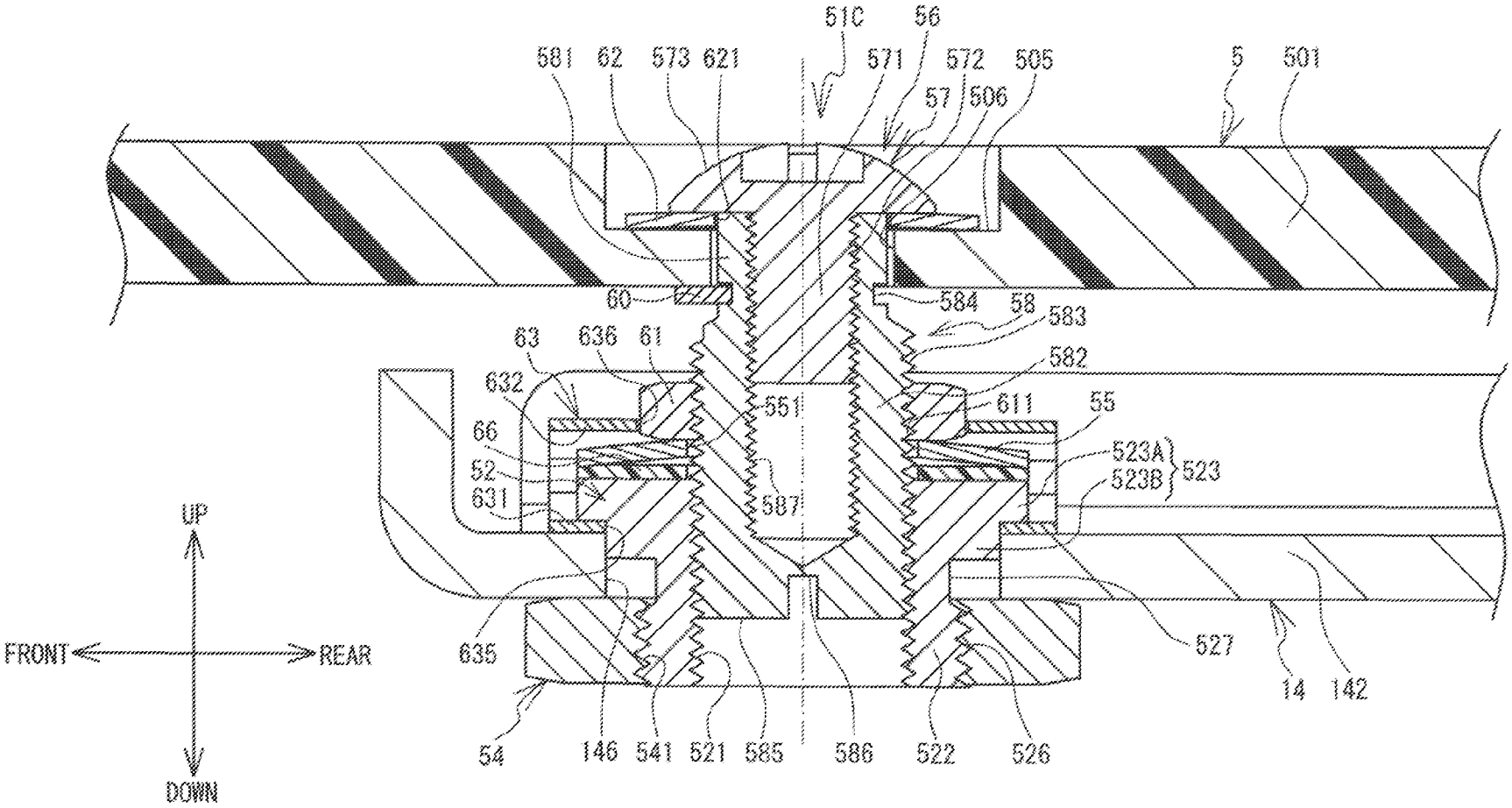
FIG. 9 is a section view of a leveling mechanism 51C according to a modified example.

A sheet 66 may also be disposed between the first disk spring 55 and the threaded member 52, as in a leveling mechanism 51C according to a modified example that is shown in FIG. 9. The sheet 66 is circular in a plan view, with a hole in the its center, and it is disposed around the circumference of the shaft 582 of the adjusting screw 56. The sheet 66 may be made of a synthetic resin, for example. A frictional force that is generated between the sheet 66 and the first disk spring 55 and a frictional force that is generated between the sheet 66 and the threaded member 52 are greater than the frictional force that is generated between the first disk spring 55 and the threaded member 52 that are shown in FIG. 6. With this configuration, because the frictional forces are greater, the threaded member 52 becomes more resistant to turning when the adjusting screw 56 is turned than it is in a case where the sheet 66 is not provided. The distance between the nut 61 and the threaded member 52 is therefore less likely to change, and the restoring force of the first disk spring 55 is maintained. The possibility that backlash will occur in the platen 5 that is attached to the adjusting screw 56 can therefore be reduced. Note that the leveling mechanism 51 may also be provided with both the sheet 65 (refer to FIG. 8) and the sheet 66 (refer to FIG. 9).

What is claimed is:

1. A printer, comprising:

a discharge portion that is configured to discharge a liquid;

a platen in which a platen hole is formed, the platen being disposed to face the discharge portion and configured to support a printing medium;

a support portion that is disposed on the opposite side of the platen from the discharge portion and configured to face the platen;

a female screw that is provided on the support portion and that includes a threaded hole;

an adjusting member that is provided with a male screw having a male thread that threadedly engages with the thread hole of the female screw, the adjusting member being configured to be rotatably attached to the platen by being inserted into the platen hole;

an engaging member that is disposed between the platen and the female screw, and that threadedly engages with the male thread of the male screw of the adjusting member; and a spring that is disposed between the engaging member and the female screw, that is disposed around the circumference of the adjusting member, and that generates a restoring force when the spring compressed between the engaging member and the female screw.

2. The printer according to claim 1, further comprising:

a locking portion that is supported by the support portion and that locks rotation of the engaging member.

3. The printer according to claim 1, wherein raised and recessed portions are formed in a surface of the spring.

4. The printer according to claim 1, further comprising:

a first member that is disposed between the spring and the engaging member, wherein a frictional force that is generated between the first member and the spring and a frictional force that is generated between the first member and the engaging member are greater than a frictional force that is generated between the spring and the engaging member.

5. The printer according to claim 1, further comprising:

a second member that is disposed between the spring and the female screw, wherein a frictional force that is generated between the second member and the spring and a frictional force that is generated between the second member and the female screw are greater than a frictional force that is generated between the spring and the female screw.

6. The printer according to claim 1, wherein an end of the adjusting member on the opposite side of the platen is positioned closer to the platen than is an end of the female screw on the opposite side of the platen.

7. The printer according to claim 1, wherein the spring is a disk spring that is downwardly sloped toward an outside in a radial direction.

8. The printer according to claim 7, wherein the spring contacts with the engaging member at an inside of the spring in the radial direction.

9. The printer according to claim 7, wherein the spring contacts with the female screw at an outside of the spring in the radial direction.

* * * * *